United States Patent [19]

Jewett

[11] Patent Number: 4,531,328

[45] Date of Patent: Jul. 30, 1985

[54] TOOTH REST FOR CUTTER GRINDER

[76] Inventor: Bryce D. Jewett, 2901 Maury St., Richmond, Va. 23224

[21] Appl. No.: 655,238

[22] Filed: Sep. 28, 1984

Related U.S. Application Data

[62] Division of Ser. No. 464,151, Feb. 7, 1983, abandoned.

[51] Int. Cl.[3] ..... B24B 41/06

[52] U.S. Cl. ..... 51/238 T; 51/225; 33/185 R; 33/201

[58] Field of Search ..... 51/288, 225, 238 T; 33/185 R, 201

[56] References Cited

U.S. PATENT DOCUMENTS

| | | | |
|---|---|---|---|
| 1,834,815 | 12/1931 | Winans | 51/225 |
| 2,035,163 | 3/1936 | Holmberg | 51/225 |
| 2,484,590 | 10/1949 | Rocheleau | 51/225 |
| 2,569,855 | 10/1951 | Hertlein | 51/225 |
| 2,770,930 | 11/1956 | Norman | 51/225 |

FOREIGN PATENT DOCUMENTS

| | | | |
|---|---|---|---|
| 704028 | 2/1954 | United Kingdom | 51/225 |

*Primary Examiner*—Harold D. Whitehead
*Attorney, Agent, or Firm*—Norman B. Rainer

[57] ABSTRACT

A method for the precision sharpening of the cutting edges of a fluted milling tool having a cylindrical cutting head, and apparatus for positioning the milling tool during sharpening. The method involves supportively contacting the flutes with an abutment finger capable of adjustable movement in a path perpendicular to the axis of the tool, whereby the cutting edge is accurately presented to a grinding wheel. The apparatus provides means whereby the position of the abutment finger may be controlled to provide cutting edges of a predetermined angle for tools of various diameter.

3 Claims, 9 Drawing Figures

TOOTH REST FOR CUTTER GRINDER

RELATED APPLICATIONS

This is a divisional application based upon application Ser. No. 464,151, filed 02/07/83 now abandoned.

BACKGROUND OF THE INVENTION

This invention concerns a method and apparatus for sharpening the cutting edges of metal-cutting tools, and more particularly relates to a method for accurately sharpening a milling tool having a number of cutting edges in a circular cylindrical array, and apparatus for positioning said milling tool for sharpening.

Milling tools are extensively used for the machining of metal structures to desired shapes. The milling tool, generally fabricated of special alloy steel having a very high hardness, is an integral monolithic structure comprised of a spindle or shaft portion and a cutting head portion disposed at an extremity of said shaft portion and coaxial therewith. The cutting head is comprised of a core which is substantially a continuation of the shaft, and a number of flutes upraised from the core, the outermost extremities of said flutes having elongated cutting edges in parallel juxtaposition symmetrically disposed about the tool axis. The present invention is concerned specifically with those milling tools wherein the cutting edges which define the perimeter of the head are disposed in a circular cylindrical locus about the tool axis, said edges being either straight and parallel to the axis, or helically disposed to the axis. The diameter of the cylindrical perimeter of the cutting head will generally range from about 0.125" to 2.0".

The cutting edge is comprised of two surfaces which converge to a V-shaped apex. One of said surfaces may be considered to be the exterior surface, disposed on the outer periphery of the tool. The second surface, which may be considered to be the interior surface, is substantially radially oriented with respect to the shaft axis. The angle of the cutting edge or apex is between 88° and 70°, and preferably between 86° and 81°, the smaller angled cutting edges being used on workpiece substrates of greater hardness. The cutting edge angle may sometimes be expressed as the degrees of angle to which the exterior surface is cut back from its unsharpened or 90° tangential state. In such manner of defining the angle of the cutting edge, values between 2° and 20° are the same as the values of 88° to 70° expressed above.

When the milling tool is rotated at high speed about the shaft axis, and the cutting edges are forcibly brought to bear against a metal workpiece of ordinary hardness, metal will be controllably removed from surfaces of the workpiece by a shearing type of cutting action. After extended use, the cutting edges lose their sharpness and require re-sharpening.

Sharpening is generally accomplished by contacting the outer surface of the cutting edges with a rapidly rotating abrasive wheel comprised of a composition containing alundum, carborundum, diamond or other materials having a hardness above 9.0 on the original Mohs Hardness Scale. In order to secure an accurate and uniform cutting edge angle, special holding and guiding equipment is required to precisely present the cutting edges to the abrasive wheel. Such equipment heretofore available for the precision sharpening of milling tools has required time-consuming manipulations and repeated adjustments to secure the sought cutting edge angle, and to compensate for factors such as the diameter of the cutting head.

It is accordingly an object of the present invention to provide an apparatus for the precision rapid sharpening of the cutting edges of a milling tool.

It is another object of this invention to provide an apparatus as in the foregoing object capable of easily accommodating milling tools having cutting heads of various diameter.

It is a further object of the invention to provide an apparatus of the aforesaid nature capable of adjustably producing an accurate, uniform cutting edge angle on cutting heads of various diameter.

It is a still further object of this invention to provide apparatus for positioning the cutting edges of a milling tool for sharpening, said apparatus having position-compensating means to accommodate milling tools of different diameters.

These objects and other objects and advantages of the invention will be apparent from the following description.

SUMMARY OF THE INVENTION

The above and other beneficial objects and advantages are accomplished in accordance with the present invention by an improved method for sharpening the cutting edges of a cylindrical cutting head of a milling tool comprised of a shaft and multifluted cutting head disposed at an extremity of said shaft and coaxial therewith, said method comprising: (a) supporting said milling tool by its shaft in mounting means in a manner to permit rotational motion of the tool about its axis and reciprocal motion along its axis, (b) supportively contacting a flute with an abutment finger capable of adjustable positioning in a straight line path perpendicular to said axis and displaced therefrom, (c) causing successive portions of the exterior surface of the cutting edge of the flute contacted by said abutment finger to substantially tangentially contact a surface of a rapidly rotating abrasive wheel, the disposition of said tool with respect to said abrasive wheel being such as to impart a sharpening effect to the cutting edge at the sought angle, and (d) rotating the tool by said mounting means and repeating steps b and c until all the cutting edges of the tool are sharpened. The abutment finger is brought into proper engagement with a flute preferably by entrance into the space between the flutes from either the forward extremity or rear extremity of the cutting head.

The apparatus of this invention is adapted to be located generally below the milling tool mounted for sharpening and adjacent the abrasive wheel. The apparatus is designed to permit precise positioning of an abutment finger in a straight line path in a manner to facilitate sharpening of the tool at a sought cutting edge angle, and to permit facile adjustment in the position of said finger to compensate for tools of different diameter. Said apparatus is comprised of a housing having a substantially flat base, a channel disposed perpendicularly to said base, pedestal means and associated abutment finger slideably engaged by said channel, and threaded adjustment means adapted to cause movement of said pedestal means within said channel. Locking means are associated with said channel to controllably prevent movement of said pedestal means. Threaded selector means extend perpendicularly from fixed engagement with said pedestal means and support an upwardly directed pointer adapted to be moved along the length of said selector means. A first indicator scale, in the form of a pivotably mounted beam having a pointed free extremity, is adapted to rest by gravitational force upon said pointer, said first indicator scale containing uniformly spaced markings representing linear distance corresponding to the diameter of the cutting head of the tool to be sharpened. A second indicator scale of spaced markings corresponding to degrees of angle is fixedly positioned adjacent the pointed free extremity of the first indicator scale. The pivoted first indicator scale and stationary second indicator scale are visible from the front of said housing. In preferred embodiments, both indicator scales are in substantially coplanar alignment perpendicularly disposed to the flat base of the housing, and said second indicator scale is inscribed in an arcuate locus.

In operation, the selector means is adjusted so that the pointer is positioned under a site on said first indicator scale corresponding to the diameter of the cylindrical cutting head of the cutting tool to be sharpened. The threaded adjustment means is then manipulated to cause movement of the pedestal means within the channel and simultaneous movement of the first indicator scale about the pointer which serves as a fulcrum. Such manipulation of the adjustment means is continued until the pointed free extremity of the first indicator scale rests opposite a desired angle of cutting edge on the stationary second indicator scale. The position of the pedestal means within the channel is then fixed by the locking means. In said locked position, the uppermost extremity or point of the abutment finger supportively contacts the flute associated with a cutting edge in a manner such that, in conjunction with other aforesaid process and apparatus features, the cutting edge is uniformly sharpened to a desired angle.

In the accessory equipment utilized in conjunction with the apparatus of this invention for achieving the sharpening process of this invention, provision must be made for adjusting the distance between the mounted tool and the abrasive wheel in order to accommodate tools of different diameters. Such distance adjustment may be accomplished by causing the abrasive wheel or the tool mounting means or both to have positional adjustment.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
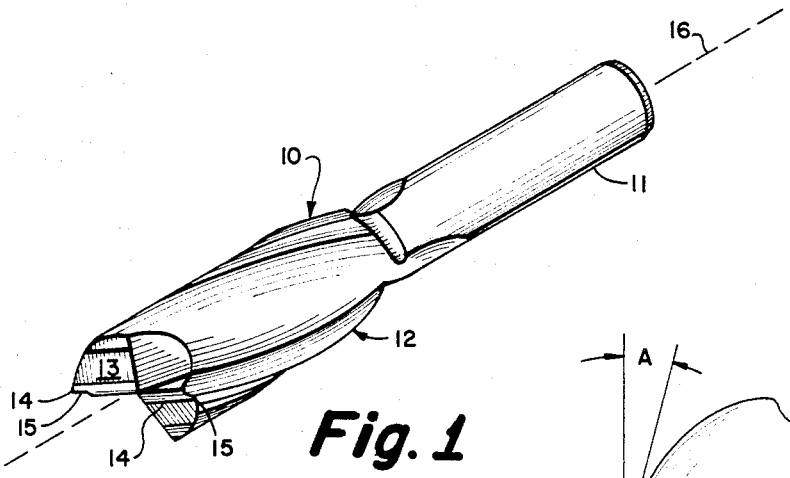
FIG. 1 is a perspective view of an embodiment of milling tool which can be sharpened by the method and apparatus of this invention.

Referring to FIG. 1, a milling tool 10 of monolithic construction is shown comprised of a shaft portion 11 and a cutting head portion 12 disposed at one extremity of said shaft portion and coaxial therewith. The cutting head is comprised of a core 13 and a number of flutes 14 upraised from the core. The flutes have elongated cutting edges 15 in parallel juxtaposition symmetrically disposed about the tool axis 16. Cutting edges 15, shown to be helical in the embodiment of FIG. 1, are located in a circular cylindrical array or locus about said axis, and the cutting head may accordingly be said to be of the cylindrical type. In other embodiments of cylindrical cutting heads which may be sharpened by the method and apparatus of this invention, the flutes and cutting edges may be straight and disposed parallel to axis 16. The diameter of the cutting head may be considered to be the diameter of the circular cylindrical array of cutting edges.

Figure 3:
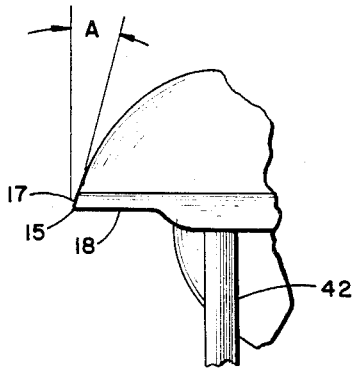
FIG. 3 is an enlarged fragmentary end view of the milling tool of FIG. 1.
Figure 2:
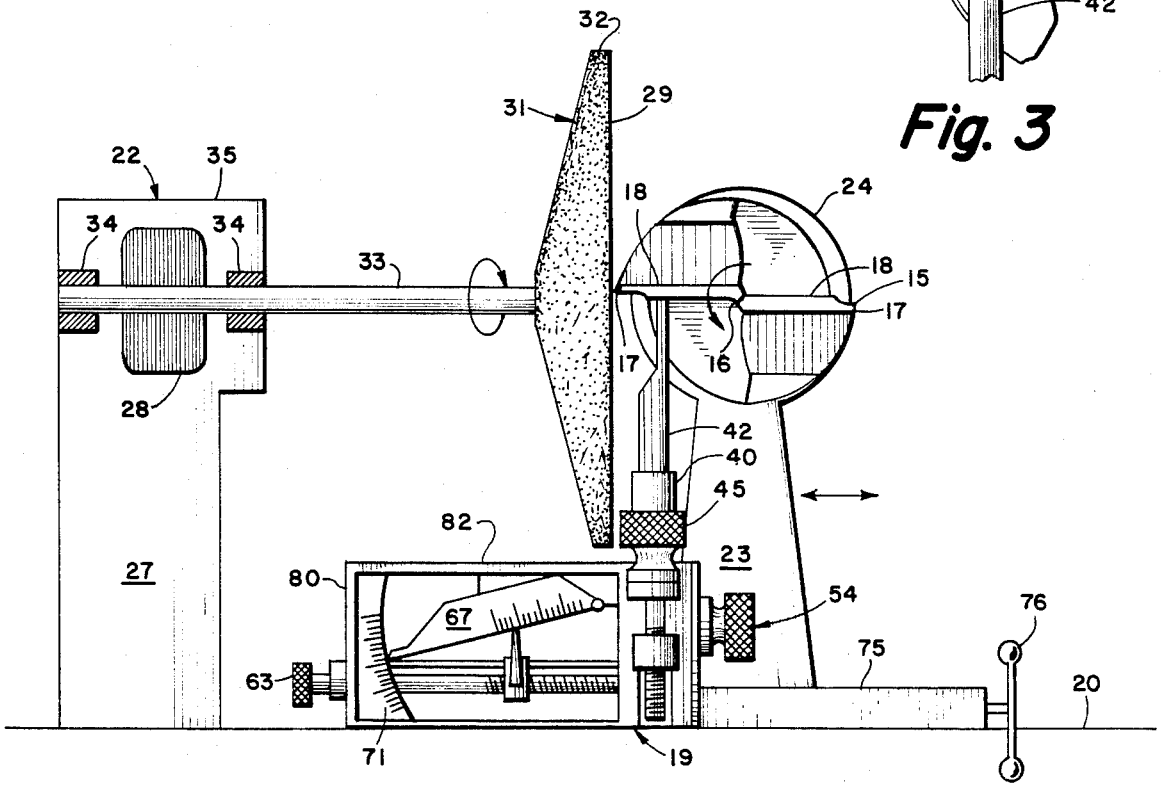
FIG. 2 shows an enlarged end view of the milling tool of FIG. 1 in association with an abrasive wheel and apparatus of this invention in preparation for a sharpening operation.

Each cutting edge, as shown more clearly in FIGS. 2 and 3, is comprised of an exterior surface 17 disposed on the outer periphery of the cutting head, and an interior surface 18 substantially radially oriented with respect to the tool axis. The two surfaces 17 and 18 meet at an apex which constitutes the cutting edge 15. The angle of the cutting edge, indicated as angle A in FIG. 3, should be between about 2° and 20°, and preferably between 3° and 9°. The interior surface 18 of angle A is shown as a surface which proceeds in a generally radial direction with respect to axis 16 as part of flute 14.

Figure 4:
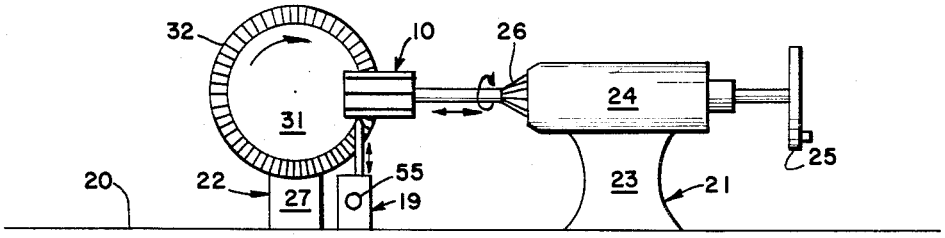
FIG. 4 is a schematic side view of an assembly of the apparatus of this invention and accessory equipment useful in the sharpening method of this invention.
Figure 5:
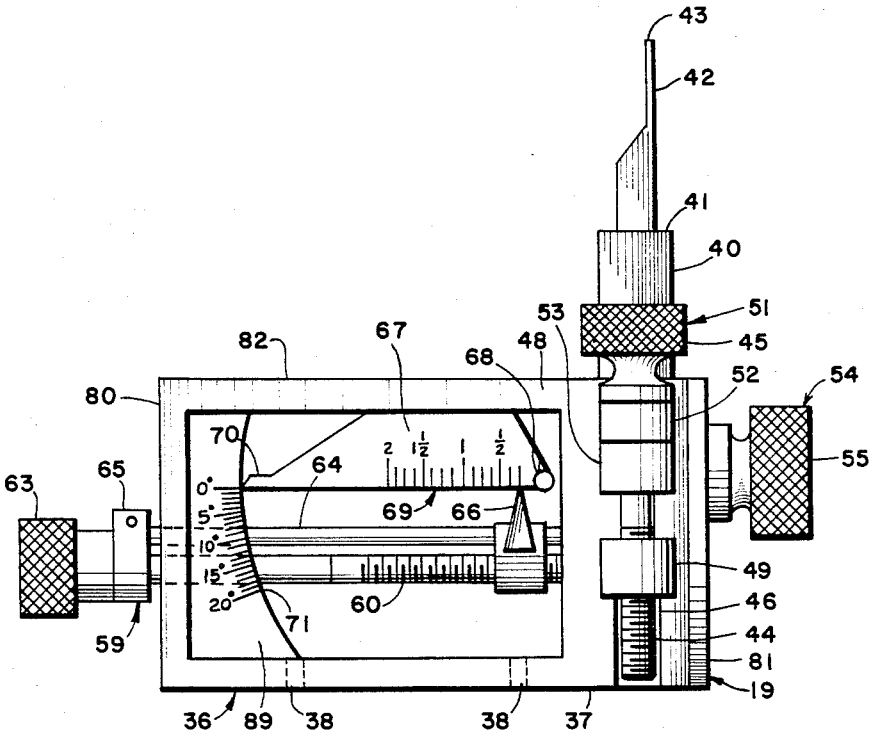
FIG. 5 is an enlarged front view of the positioning apparatus of this invention.
Figure 6:
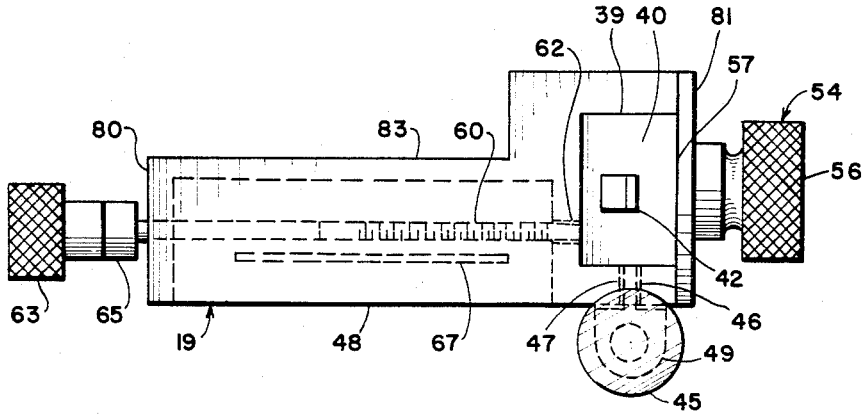
FIG. 6 is a top view of the apparatus of FIG. 5.
Figure 8:
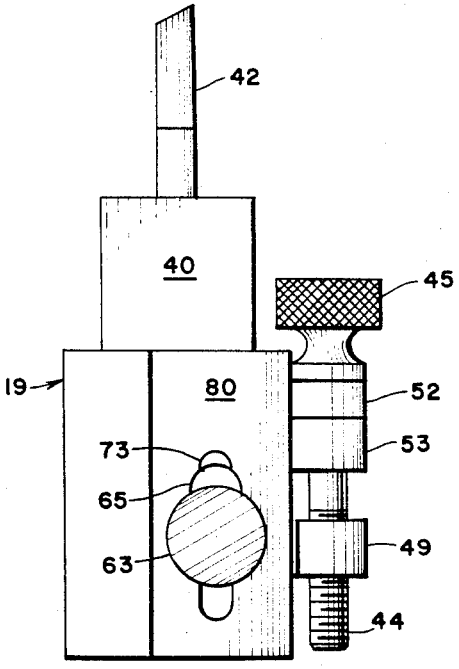
FIG. 8 is a view of the left side of the apparatus of FIG. 5.
Figure 7:
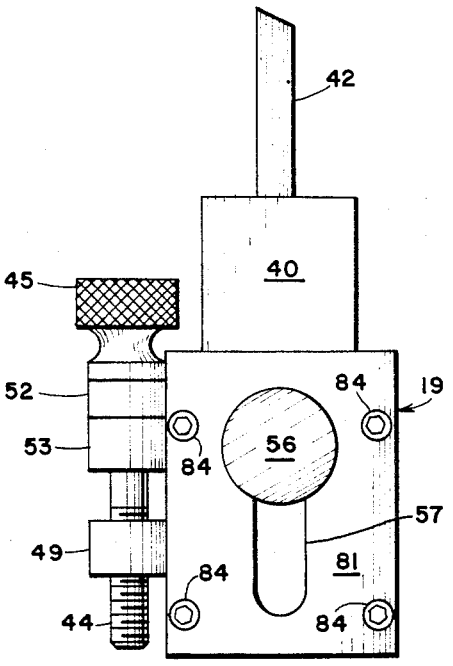
FIG. 7 is a view of the right side of the apparatus of FIG. 5.
Figure 9:
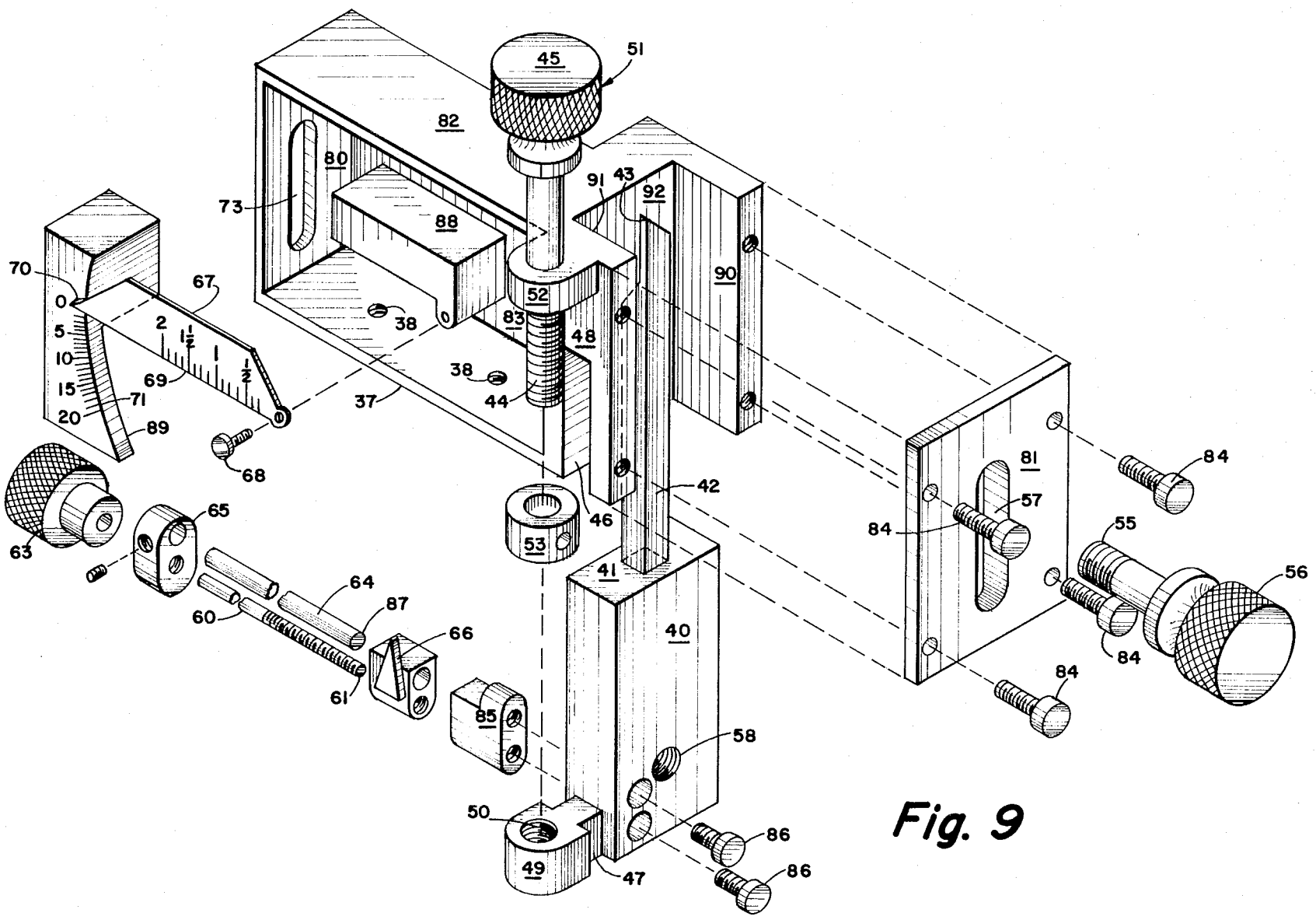
FIG. 9 is an exploded view of the apparatus of FIG. 5.

FIG. 4 illustrates an embodiment of assembly of apparatus components useful in carrying out the sharpening method of this invention and further indicates the context in which the positioning apparatus 19 of this invention functions. A stable base structure 20 is provided, upon which is mounted holding means 21, positioning apparatus 19, and grinding unit 22.

Holding means 21 is comprised of a base 23 and cylindrical slide 24 having a hand-operated handle 25 which communicates with adjustable collet chuck 26. The wheel and associated chuck are adapted to permit movement of said chuck in a reciprocal manner in line with the chuck axis, and rotational movement about said axis, said movements being indicated by the arrows in FIG. 4. Base 23 is mounted upon slide plane 75 shown in FIG. 2 keyed to base structure 20 and adapted to be moved horizontally toward and away from grinding unit 22 by manipulation of wheel 76.

The grinding unit is comprised of support base 27 associated with driving means such as motor 28. A cup-shaped abrasive disc 31 having a flat outer surface 29 of circular perimeter 32 is mounted upon spindle 33 which is rotatively supported by bushings 34 within housing structure 35, and driven by motor 28.

Positioning apparatus 19 of this invention as shown in FIGS. 5 through 9 is comprised of housing 36 having a substantially flat base panel 37 provided with mounting means such as threaded holes 38 to facilitate mounting to base structure 20. The housing is further comprised of right or first side panel 81, left or second side panel 80, upper panel 82, front face 48, and rear panel 83, said panels having generally rectangular contours and associated in box-like manner. The housing may be of integral construction or assembled from separate components using bolts 84 or other fastening means.

A block-like pedestal 40 is disposed adjacent one extremity of housing 36 in perpendicular orientation to base 37, and adapted to be slideably positioned within channel 39. Said channel 39 is defined by the interior face of right side panel 81, opposed parallel walls 90 and 91, and transverse wall member 92. In equivalent alternative embodiments of the apparatus channel 39 may be otherwise and more simply constructed.

Although the cross sections of said pedestal and channel are shown as rectangular in the embodiment exemplified in the drawing, it is to be understood that other configurations may be utilized and are contemplated within the purview of this invention. It is to be noted however that the shape of the channel is that generated by a generatrix line moved about a closed path and vertical thereto, and accordingly may be defined as a cylindrical or prismatic shape. Extending from the upper extremity 41 of said pedestal is a fixedly mounted abutment finger 42 terminating in angled tip 43.

A first slot 46 communicates between channel 39 adjacent its lower extremity and front face 48 of said housing. A second slot 62, shown in FIG. 6, communicates between said channel and the interior of said housing. A keying bar 47 adapted to slideably engage slot 46 extends perpendicularly from the lower extremity of pedestal 40 through front face 48. A tab 49 containing an internally threaded passage 50 on an axis parallel to said pedestal is associated with the forward extremity of keying bar 47.

Threaded adjustment means 51 are comprised of partially threaded shaft 44 rotatively journaled to collar 52 associated with front face 48, said shaft threadably engaging tab 49 and being equipped at its upper extremity with knurled knob 45. A retaining ring 53 attached to shaft 44 abuts against the lower extremity of collar 52 in a manner to prevent axial movement of said shaft with respect to said collar. By virtue of the aforesaid arrangement of parts, threaded adjustment means 51 causes movement of pedestal 40 within channel 39, said movement being achieved by the turning of knurled knob 45.

Locking means 54 are comprised of threaded bolt 55 having knurled head 56, said threaded bolt being in sliding engagement with slot 57 communicating through right side panel 81, and engaging threaded hole 58 of pedestal 40. By tightening bolt 55, pedestal 40 is caused to be locked in its position within channel 39.

Selector means 59 are comprised of: (a) partially threaded rod 60 having an outer extremity to which knurled knob 63 is attached, said rod passing through bushing collar 65 and slot 73 in left side panel 80 of said housing, the interior extremity 61 of said rod being journaled to holding block 85 attached to pedestal 40 by recessed bolts 86 and adapted to slide within slot 62, (b) fixed guide bar 64 disposed closely above and parallel to rod 60, the outer extremity of said guide bar passing through slot 73 to attachment with collar 65, and its inner extremity 87 engaging holding block 85, (c) a fulcrum pointer 66 which threadably engages rod 60 and slidably engages guide bar 64, (d) a lever scale 67 mounted by pivot bolt 68 to block 88 attached to rear panel 83 of said housing, said lever scale having a straight lower edge 69 adapted to rest upon pointer 66, a pointed free extremity 70, and a series of uniformly spaced markings corresponding to tool diameter measured from the center of pivot bolt 68, and (e) a stationary scale of uniformly spaced markings 71 corresponding to degrees of angle and positioned on plate 89 mounted adjacent left panel 80 of said housing adjacent pointed free extremity 70 of lever scale 67, said markings being arranged in a circular arc so that the uppermost marking corresponds to a cutting edge angle of 0°, and subsequent lower markings correspond to larger angles.

It is to be noted that, in operation, the positioning apparatus of this invention simulates certain positional interrelationships during a sharpening operation. Specifically, pivot bolt 68 represents axis 16 of the milling tool, the straight lower edge 69 of lever scale 67 represents the radially extended interior cutting edge surface 18, and fulcrum pointer 66 represents the tip 43 of finger 42. For example, when fulcrum pointer 66 is moved toward the pointed free extremity of lever scale 67, such movement corresponding to cutting heads of larger diameter, the lever scale must be allowed to be lowered to re-establish the same indicated angle on the stationary scale. Such lowering of the lever scale is accomplished by lowering finger 42 by means of adjustment means 51. Conversely, by re-positioning the fulcrum pointer closer to the pivot means, corresponding to cutting heads of smaller diameter, the finger must be elevated to re-establish the same cutting edge angle. The appropriateness of such manipulations can be verified by the geometrical relationships shown in FIGS. 2 and 3.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for positioning a milling tool having a number of cutting edges in a circular cylindrical array, said apparatus being comprised of (a) a housing having a substantially flat base adapted for mounting to a horizontal support surface, and first and second side extremities, (b) a channel disposed perpendicularly to said base adjacent said first side extremity, (c) elongated pedestal means slideably engaged by said channel, (d) an elongated abutment finger extending upwardly from said pedestal means, (e) threaded adjustment means adapted to cause vertical movement of said pedestal means within said channel, (f) locking means associated with said channel adapted to controllably prevent movement of said pedestal means, and (g) selector means comprising (1) a threaded rod rotatably journaled to said pedestal means and extending perpendicularly therefrom above said base to slotted engagement with said second side extremity, (2) an upwardly directed pointer adapted to be moved horizontally in response to rotational movement of said threaded rod, (3) a lever scale pivotably mounted above said threaded rod and having a straight lower edge adapted to rest by gravitational force upon said pointer, said lever scale having a pointed free extremity and a series of uniformly spaced markings representing linear distance corresponding to the diameters of milling tools to be sharpened, and (4) a stationary scale of markings corresponding to degrees of angle of a cutting edge, said scale being associated with said second side extremity and positioned adjacent the pointed free extremity of said lever scale, whereby (h) when the horizontal position of the pointer is adjusted so as to reside under that site of the lever scale representing the diameter of the milling tool to be sharpened, vertical adjustment of the pedestal, with attendant vertical movement of said pointer and finger causes the pointed free extremity of said lever scale to indicate the sought angle of sharpening on said stationary scale and causes the elevation of the abutment finger to be exactly appropriate to support said milling tool for securement of the sought angle of sharpening of said cutting edges.

2. The apparatus of claim 2 wherein said channel is of generally prismatic or cylindrical configuration.

3. The apparatus of claim 2 wherein said lever scale and stationary scale are substantially coplanar and vertical to said base.

* * * * *